US007524039B2

(12) United States Patent
Mita

(10) Patent No.: US 7,524,039 B2
(45) Date of Patent: Apr. 28, 2009

(54) LIQUID EJECTION HEAD AND IMAGE FORMING APPARATUS

(75) Inventor: Tsuyoshi Mita, Kanagawa (JP)

(73) Assignee: Fujifilm Corp., Tokyo (JP)

( * ) Notice: Subject to any disclaimer, the term of this patent is extended or adjusted under 35 U.S.C. 154(b) by 521 days.

(21) Appl. No.: 11/434,804

(22) Filed: May 17, 2006

(65) Prior Publication Data

US 2006/0262166 A1 Nov. 23, 2006

(30) Foreign Application Priority Data

May 18, 2005 (JP) ..... 2005-145810

(51) Int. Cl.
*B41J 2/045* (2006.01)

(52) U.S. Cl. ..... 347/68

(58) Field of Classification Search ..... 347/68, 347/69–72

See application file for complete search history.

(56) References Cited

U.S. PATENT DOCUMENTS 4,383,264 A * 5/1983 Lewis ..... 347/68
5,666,141 A * 9/1997 Matoba et al. ..... 347/54
2001/0033313 A1 10/2001 Ohno et al.

FOREIGN PATENT DOCUMENTS

| | | | |
|---|---|---|---|
| JP | 2-253962 | A | 10/1990 |
| JP | 8-58085 | A | 3/1996 |
| JP | 11-123821 | A | 5/1999 |
| JP | 2001-334674 | A | 12/2001 |
| JP | 2004-237676 | A | 8/2004 |

* cited by examiner

*Primary Examiner*—K. Feggins
(74) *Attorney, Agent, or Firm*—Birch, Stewart, Kolasch & Birch, LLP

(57) ABSTRACT

The liquid ejection head comprises: a pressure chamber which is connected to an ejection port ejecting liquid, the liquid being supplied to the pressure chamber from a supply flow channel; and a piezoelectric element which forms a wall surface of the pressure chamber facing to the ejection port, wherein, during liquid ejection, the liquid inside the pressure chamber is pressurized by means of displacement of the piezoelectric element in d33 direction, and a gap formed between a partition of the pressure chamber and the piezoelectric element is made narrower than during refilling, in such a manner that flow resistance of the liquid from the pressure chamber toward the supply flow channel becomes greater than during refilling.

5 Claims, 4 Drawing Sheets

LIQUID EJECTION HEAD AND IMAGE FORMING APPARATUS

BACKGROUND OF THE INVENTION

1. Field of the Invention

The present invention relates to a liquid ejection head and an image forming apparatus, and more particularly, to a liquid ejection head and an image forming apparatus which eject liquid from ejection ports connected to pressure chambers, by utilizing the displacement of piezoelectric elements.

2. Description of the Related Art

An inkjet recording apparatus is known which forms images on a recording medium by ejecting ink droplets from nozzles, while moving a print head (liquid ejection head) in which a plurality of nozzles are formed, relatively with respect to the recording medium. One ejection method for a print head installed in an inkjet recording apparatus of this kind is a piezoelectric method which ejects ink droplets from the nozzles connected to pressure chambers, by utilizing the displacement of piezoelectric elements to change the volume of pressure chambers filled with ink, thereby pressurizing the ink filled into the pressure chambers.

Japanese Patent Application Publication Nos. 8-58085 and 11-123821 disclose print heads in which pressure chambers, and piezoelectric elements disposed in positions opposing the ink supply flow channel and corresponding to these pressure chambers, are arranged respectively on either side of a diaphragm which constitutes a wall of the pressure chambers. In these print heads, during ink ejection, the cross-sectional area of the ink supply flow channel is reduced by the diaphragm due to the deformation of the piezoelectric element, thereby preventing reverse flow of the ink from the pressure chambers toward the common liquid chamber. However, in these print heads, the ink inside the pressure chambers is indirectly pressurized by means of a diaphragm, and hence there is a problem in that the ink ejection efficiency is poor in relation to the displacement of the piezoelectric elements.

Japanese Patent Application Publication No. 2-253962 discloses a print head in which the ink flow channel is divided into two sides by an elastic movable actuator having a cantilever beam structure, one side forming a nozzle side and the other side forming a flow channel side connecting to a common liquid chamber. In this print head, the ink is supplied to the nozzle side through a gap between the side wall of the ink flow channel and the elastic movable actuator. During refilling, the elastic movable actuator disposed inside the ink flow channel acts in a direction that increases the volume on the nozzle side, while during ink ejection, it acts in a direction that reduces the volume on the nozzle side. However, no consideration is given to the ink ejection efficiency with respect to the displacement of the elastic movable actuator.

Japanese Patent Application Publication No. 2001-334674 discloses a print head in which nozzles, pressure chambers (ink chambers) and a common liquid chamber (ink pool) are constituted by a single substrate, piezoelectric elements being disposed on the opposite side of the pressure chambers to the nozzle side, with the object of achieving an improvement in the reliability and production yield of the head, and reducing the size of the head. However, similarly to Japanese Patent Application Publication No. 2-253962, no consideration is given to the ink ejection efficiency.

Japanese Patent Application Publication No. 2004-237676 discloses a print head in which unimorph type piezoelectric elements are provided in the interior of pressure chambers. In this print head, piezoelectric elements are fixed to a diaphragm which constitutes an inner wall of the pressure chambers. In the piezoelectric element which makes contact with the ink in the pressure chamber, the displacement in the longitudinal direction, which is the liquid droplet ejection direction, and the displacement in the transverse direction which is perpendicular to this direction, are mutually conflicting, and therefore the ink ejection efficiency with respect to the displacement of the piezoelectric element is poor.

SUMMARY OF THE INVENTION

The present invention has been contrived in view of the foregoing circumstances, an object thereof being to provide a liquid ejection head and image forming apparatus in which the liquid ejection efficiency is improved.

In order to attain the aforementioned object, the present invention is directed to a liquid ejection head, comprising: a pressure chamber which is connected to an ejection port ejecting liquid, the liquid being supplied to the pressure chamber from a supply flow channel; and a piezoelectric element which forms a wall surface of the pressure chamber facing to the ejection port, wherein, during liquid ejection, the liquid inside the pressure chamber is pressurized by means of displacement of the piezoelectric element in d33 direction, and a gap formed between a partition of the pressure chamber and the piezoelectric element is made narrower than during refilling, in such a manner that flow resistance of the liquid from the pressure chamber toward the supply flow channel becomes greater than during refilling.

According to the present invention, during liquid ejection, the liquid is pressurized directly due to the displacement of the piezoelectric element in the d33 direction, and hence the pressure transmission efficiency is good. Furthermore, reverse flow of the ink from the pressure chamber toward the supply flow channel is prevented, and hence the pressure loss is small. Consequently, the liquid ejection efficiency with respect to the displacement of the piezoelectric element is improved.

Preferably, a surface of the piezoelectric element on a side facing to the ejection port has an approximately curved surface in which a central region thereof is recessed.

According to this aspect of the present invention, since the directions of propagation of the pressure applied to the liquid in the pressure chamber become concentrated at the ejection port, then the pressure loss is small and the liquid ejection efficiency is further improved.

Preferably, the pressure chamber has a tapered section in which a diameter becomes smaller toward the ejection port.

According to this aspect of the present invention, since the directions of propagation of the pressure applied to the liquid in the pressure chamber become concentrated at the ejection port, then the pressure loss is small and the liquid ejection efficiency is further improved.

Preferably, the liquid ejection head further comprises a common liquid chamber which accumulates the liquid to be supplied to the pressure chamber through the supply flow channel, the common liquid chamber being arranged on a side of the piezoelectric element reverse to a side facing to the ejection port.

According to this aspect of the present invention, the ejection port and the pressure chamber can be arranged at high density.

In order to attain the aforementioned object, the present invention is also directed to an image forming apparatus, comprising the above-described liquid ejection head.

According to the present invention, during liquid ejection, the liquid is pressurized directly due to the displacement of the piezoelectric element in the d33 direction, and hence the pressure transmission efficiency is good. Furthermore, reverse flow of the ink from the pressure chamber toward the supply flow channel is prevented, and hence the pressure loss is small. Consequently, the liquid ejection efficiency with respect to the displacement of the piezoelectric element is improved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
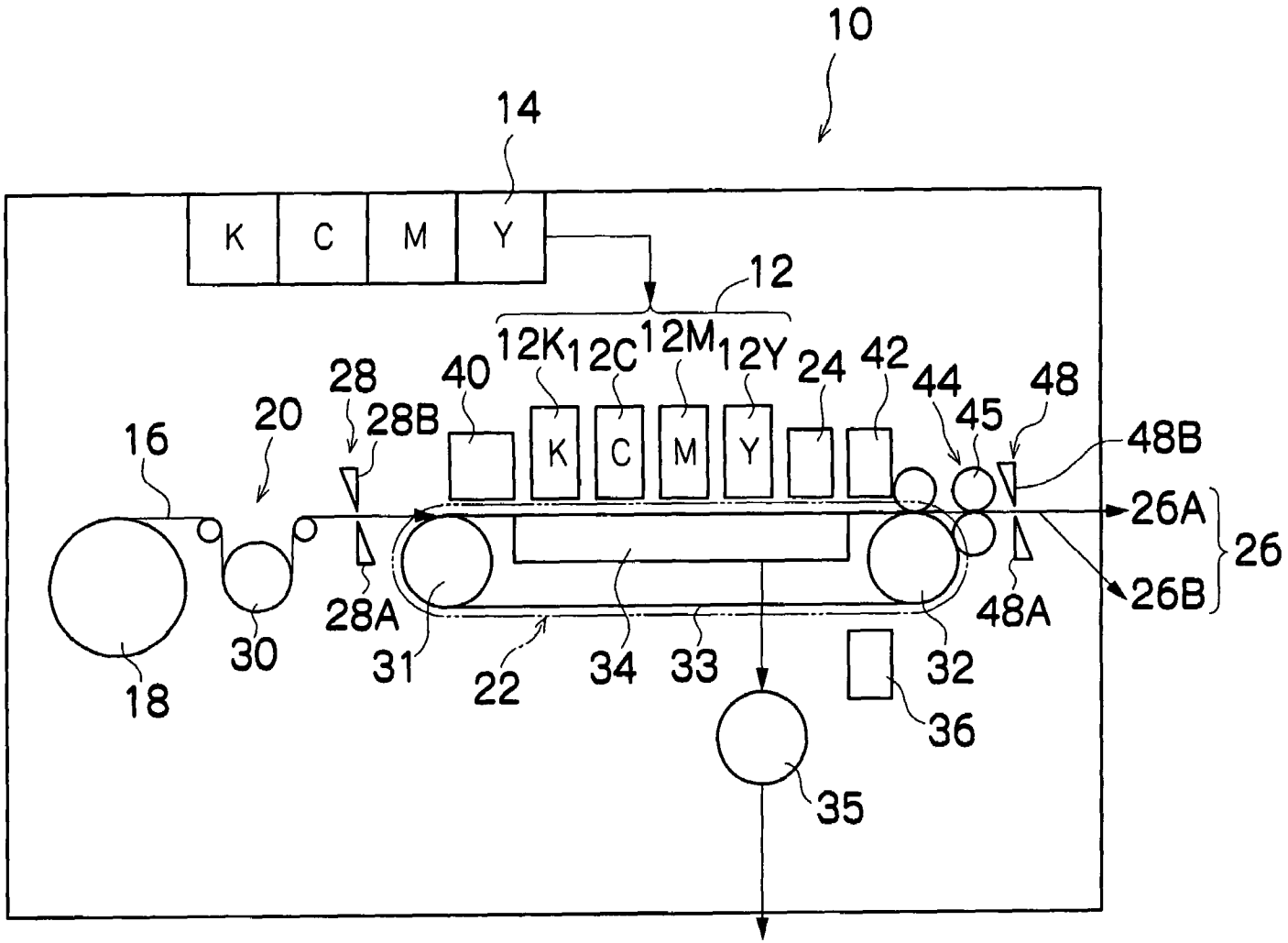
FIG. 1 is a general schematic drawing of an inkjet recording apparatus which forms an image forming apparatus according to the present invention.

FIG. 1 is a general schematic drawing of an inkjet recording apparatus which forms an image forming apparatus according to the present invention. As shown in FIG. 1, the inkjet recording apparatus 10 comprises: a print unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle face (ink droplet ejection face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite to the curl direction in the magazine. At this time, the heating temperature is preferably controlled in such a manner that the recording paper 20 has a curl in which the surface on which the print is to be made is slightly rounded in the outward direction.

After decurling, the cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the print unit 12 on the interior side of the belt 33, which is set around the rollers 31 and 32, as shown in FIG. 1; and a negative pressure is generated by sucking air from the suction chamber 34 by means of a fan 35, thereby the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with a brush roller and a water absorbent roller, an air blow configuration in which clean air is blown onto the belt 33, or a combination of these. In the case of the configuration in which the belt 33 is nipped with the cleaning roller, it is preferable to make the linear velocity of the cleaning roller different to that of the belt 33, in order to improve the cleaning effect.

Instead of the suction belt conveyance unit 22, it might also be possible to use a roller nip conveyance mechanism, but since the printing area passes through the roller nip, the printed surface of the paper makes contact with the rollers immediately after printing, and hence smearing of the image is liable to occur. Therefore, the suction belt conveyance mechanism in which nothing comes into contact with the image surface in the printing area is preferable.

A heating fan 40 is provided on the upstream side of the print unit 12 in the paper conveyance path formed by the suction belt conveyance unit 22. This heating fan 40 blows heated air onto the recording paper 16 before printing, and thereby heats up the recording paper 16. Heating the recording paper 16 before printing means that the ink will dry more readily after landing on the paper.

The print unit 12 is a so-called "full line head" in which a line head having a length corresponding to the maximum paper width is arranged in a direction (main scanning direction) that is perpendicular to the paper conveyance direction (sub-scanning direction). The print heads 12K, 12C, 12M and 12Y forming the print unit 12 are constituted by line heads in which a plurality of ink ejection ports (nozzles) are arranged through a length exceeding at least one edge of the maximum size recording paper 16 intended for use with the inkjet recording apparatus 10.

The print heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a recording head moves reciprocally in a direction (main scanning direction) which is perpendicular to the paper conveyance direction (sub-scanning direction).

Although a configuration with the KCMY four standard colors is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device or an alarm sound generator) for warning when the remaining amount of any ink is low, and has a mechanism for preventing loading errors among the colors.

The print determination unit 24 has an image sensor (line sensor) for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is output from the paper output unit 26. The target print (i.e., the result of printing the target image) and the test print are preferably output separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Moreover, although omitted from the drawing, a sorter for collating and stacking the images according to job orders is provided in the paper output section 26A corresponding to the main images.

The print heads 12K, 12M, 12C and 12Y provided for the respective ink colors have the same structure, and a reference numeral 50 is hereinafter designated to a representative embodiment of these print heads.

Structure of Print Head

Next, the structure of the print head 50 according to the present invention is described.

Figure 2:
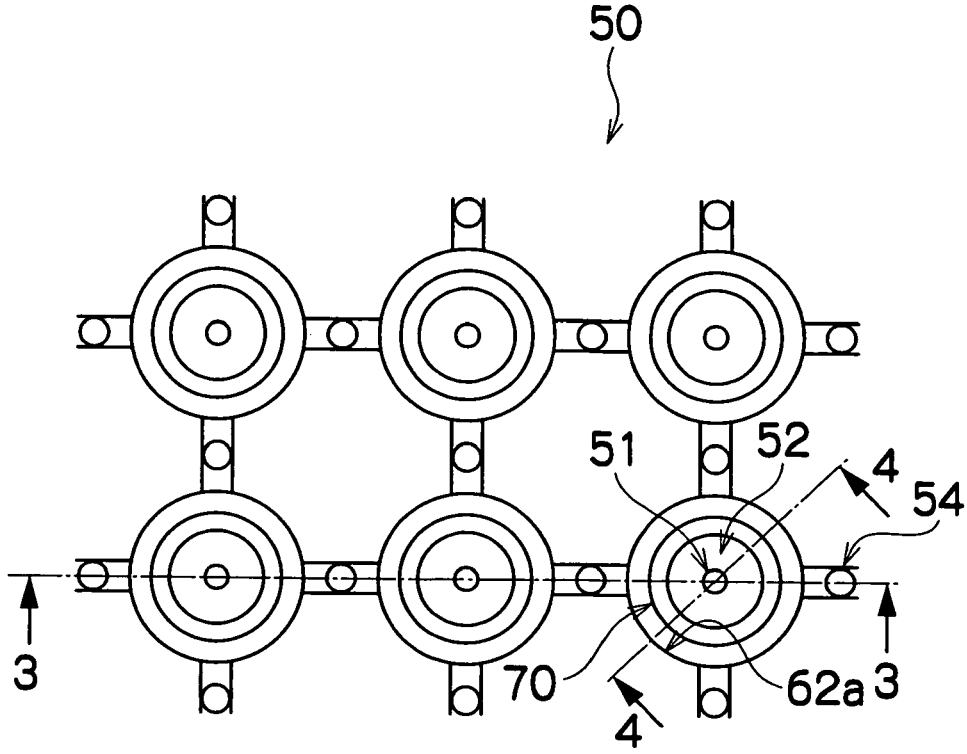
FIG. 2 is a plan view perspective diagram showing a simplified view of a portion of the print head.
Figure 3:
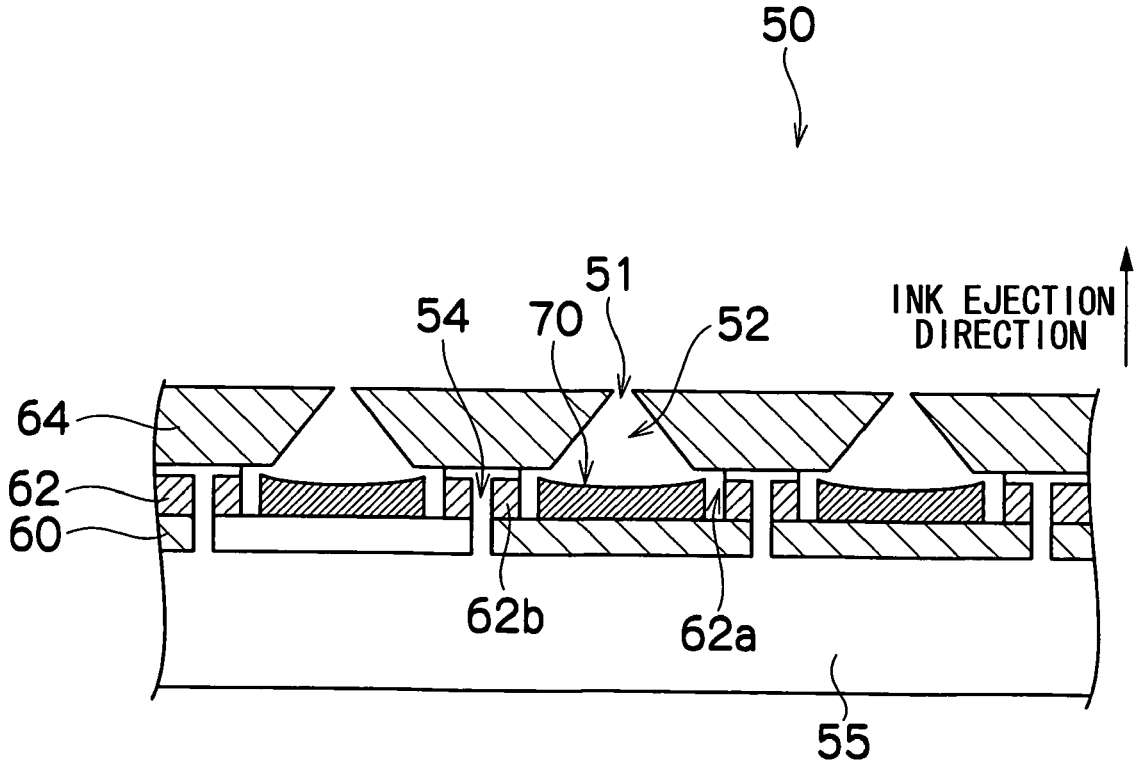
FIG. 3 is a cross-sectional diagram along line 3-3 in FIG. 2.
Figure 4:
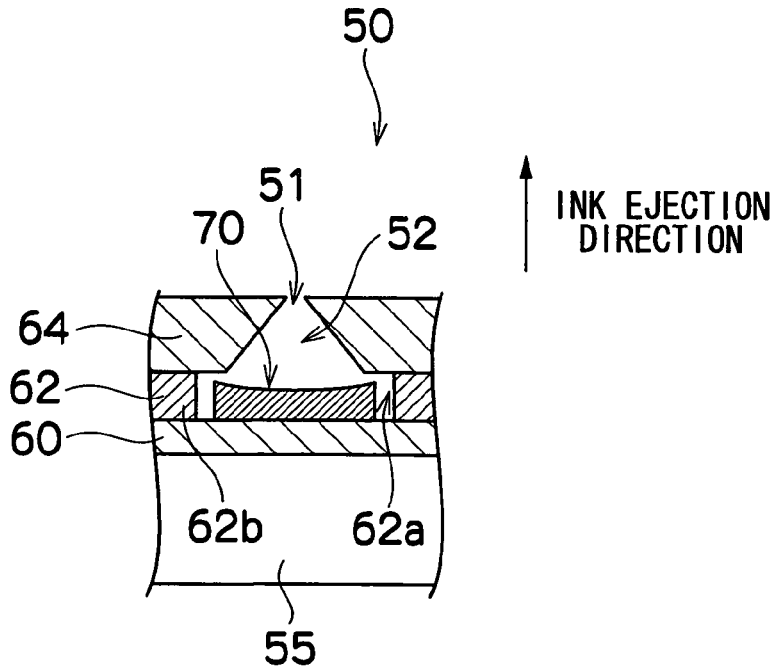
FIG. 4 is a cross-sectional diagram along line 4-4 in FIG. 2.

FIG. 2 is a plan view perspective diagram showing a simplified view of a portion of the print head 50. FIG. 3 is a cross-sectional diagram along line 3-3 in FIG. 2, and FIG. 4 is a cross-sectional diagram along line 4-4 in FIG. 2.

As shown in FIG. 2, in the print head 50 according to the present embodiment, nozzles 51 for ejecting ink droplets are arranged in a two-dimensional (matrix) configuration, and pressure chambers 52 corresponding to these nozzles 51 are also arranged in a two-dimensional (matrix) configuration.

The planar shape of the pressure chambers 52 is substantially a circular shape, being a symmetrical shape having a center substantially aligned with the nozzle 51 (see FIG. 2). The front end of the pressure chamber 52 in the ink ejection direction is formed into the nozzle 51. The cross-sectional shape of the pressure chamber 52 is a tapered shape in which the diameter gradually reduces in the ink ejection direction (toward the front end of the pressure chamber 52) (see FIGS. 3 and 4). Here, the cross-sectional shape of the pressure chamber 52 in the vicinity of a piezoelectric element 70 can be formed in a straight shape. By means of this structure, as described below, the pressure applied to the ink inside the pressure chamber 52 is concentrated toward the nozzle 51, and hence there is little pressure loss and the ink ejection efficiency is good. The planar shape of the pressure chamber 52 is not limited to a substantial circular shape, and it may be any symmetrical shape (for example, a polygonal shape) centered substantially about the position of the nozzle 51.

A cylindrical section or space 62*a* of greater diameter than the maximum diameter of the tapered pressure chamber 52 is formed on the side of the pressure chamber 52 reverse to the side forming the nozzle 51, and the piezoelectric element 70 is disposed in the cylindrical section 62*a*. The piezoelectric element 70 includes a substantially circular disk-shaped piezoelectric body having a prescribed thickness and electrodes (not shown) disposed on both surfaces of the piezoelectric body in the thickness direction, and is composed so as to be larger than the maximum diameter of the tapered pressure chamber 52, and smaller than the diameter of the cylindrical section 62*a*. The composition of the piezoelectric element 70 is described in more detail later. An ink protecting film made of resin, or the like, is formed on the parts of the piezoelectric element 70 that make contact with the ink inside the pressure chamber 52. Consequently, the side face of the pressure chamber 52 opposing the nozzle 51 is constituted by the upper surface of the piezoelectric element 70. Furthermore, a portion of an ink supply flow channel 54 described later is defined by the end portion of the upper surface of the piezoelectric element 70. The planar shape of each of the cylindrical section 62*a* and the piezoelectric element 70 is not limited to a substantially circular shape, and it may be a polygonal shape.

This print head 50 has a laminated structure in which a spacer plate 62 formed with the cylindrical sections 62*a* is bonded on a base plate 60 to which piezoelectric elements 70 are fixed, and a cavity plate 64 formed with the tapered pressure chambers 52 is bonded on the spacer plate 62, as shown in FIGS. 3 and 4. The ink ejection surface of the print head 50 according to the present embodiment is constituted by the cavity plate 64, but it is also possible to constitute the ink ejection surface of the print head 50 by a nozzle plate bonded on the cavity plate 64.

The base plate 60 constitutes the upper surface of a common liquid chamber 55, which stores ink to be supplied to the pressure chambers 52. In other words, the common liquid chamber 55 is formed on the base plate 60, to which the piezoelectric elements 70 are fixed, on the side of the base plate 60 reverse to the side where the nozzles 51 and the pressure chambers 52 are formed, so that and the nozzles 51 and the pressure chambers 52 can be arranged at high density (for example, 600 dots per inch (dpi) per row).

The supply flow channel 54 connecting the common liquid chamber 55 to the pressure chamber 52 is formed in a partition 62*b* of the spacer plate 62, and in the portion of the base plate 60 corresponding to same. The ink supply flow channel 54 is constituted by a vertical section extending in the vertical direction in FIG. 3, a horizontal section extending in the horizontal direction in FIG. 3 from the front end of the vertical section, and an end section defined by the end portion of the upper surface of the piezoelectric element 70.

Figure 5:
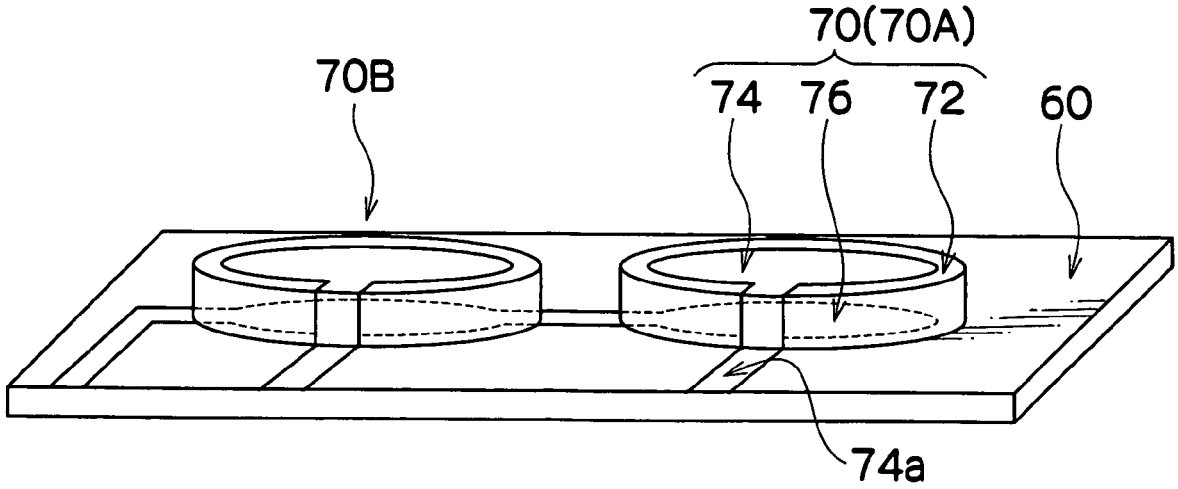
FIG. 5 is an oblique diagram showing a simplified view of piezoelectric elements on the base plate.

FIG. 5 is an oblique diagram showing a simplified view of the piezoelectric elements 70 on the base plate 60. The spacer plate 62 and the cavity plate 64 shown in FIGS. 3 and 4 are omitted in FIG. 5, in order to simplify understanding of the structure of the piezoelectric elements 70.

The piezoelectric element 70 according to the present embodiment uses elongating deformation of the piezoelectric body, and has a structure in which upper electrode 74 and lower electrode 76 are respectively disposed on upper and lower surfaces of the disk-shaped piezoelectric body 72 having a prescribed thickness. The piezoelectric elements 70A and 70B on the base plate 60 are respectively disposed inside different pressure chambers 52, and as described above, the ink protecting film (not shown) made of resin, for example, is formed on the portions of the piezoelectric elements 70A and 70B which make contact with the ink filled in the pressure chambers 52.

The upper surface of each of the piezoelectric bodies 72 of the piezoelectric elements 70 (70A and 70B) is formed with a curved surface having a recessed central portion. As shown in FIG. 5, the upper electrode 74 is arranged on the upper surface of each piezoelectric body 72, and is extended to the end section of the base plate 60 across the side surface of the piezoelectric body 72. On the other hand, the lower electrode 76 arranged on the lower surface of each piezoelectric body 72 is constituted as a single common electrode in which the adjacent lower electrodes are electrically connected to each other. This common electrode (lower electrodes) 76 is extended to the end section of the base plate 60. The electrodes 74 and 76 extended to the end section of the base plate 60 are connected through external wiring to a drive circuit (not shown) and a prescribed voltage is applied between the electrodes 74 and 76 from the drive circuit, thereby driving the piezoelectric elements 70.

The composition of the piezoelectric element 70 is not limited to that of the mode shown in FIG. 5, and it is also possible to form an electrode film over the whole surface of the base plate 60 and to use same as the common electrode, for example, or to make a base plate 60 from a metallic material and to use same as the common electrode. In these cases, it is necessary to provide an insulating layer between the common electrode and an extending section 74*a* of the upper electrode 74 on the base plate 60.

In the present specification, the "piezoelectric elements" may also include elements known as "electrostrictive elements". The piezoelectric material of the piezoelectric bodies 72 is, for example, PZT (lead titanate zirconate), barium titanate, or a relaxor material such as PNN-PT-PZ ($Pb(Ni_{1/3}Nb_{2/3})O_3$—$PbTiO_3$—$PbZrO_3$). The electrode material of the electrodes 74 and 76 is, for example, a metal, such as gold, silver, copper, nickel, platinum, or a conductive metal oxide film.

The piezoelectric body 72 of the piezoelectric element 70 in FIG. 5 is polarized in the thickness or longitudinal direction thereof, and when a prescribed voltage is applied between the electrodes 74 and 76, a strain or displacement is generated in accordance with the electric field in the longitudinal direction between the electrodes 74 and 76. Below, the displacement of the piezoelectric element 70 (piezoelectric body 72) in the thickness direction is called "longitudinal (or d33) displacement", and the displacement of the piezoelectric element 70 (piezoelectric body 72) in the direction perpendicular to the thickness direction is called "transverse (or d31) displacement".

Figure 6A:
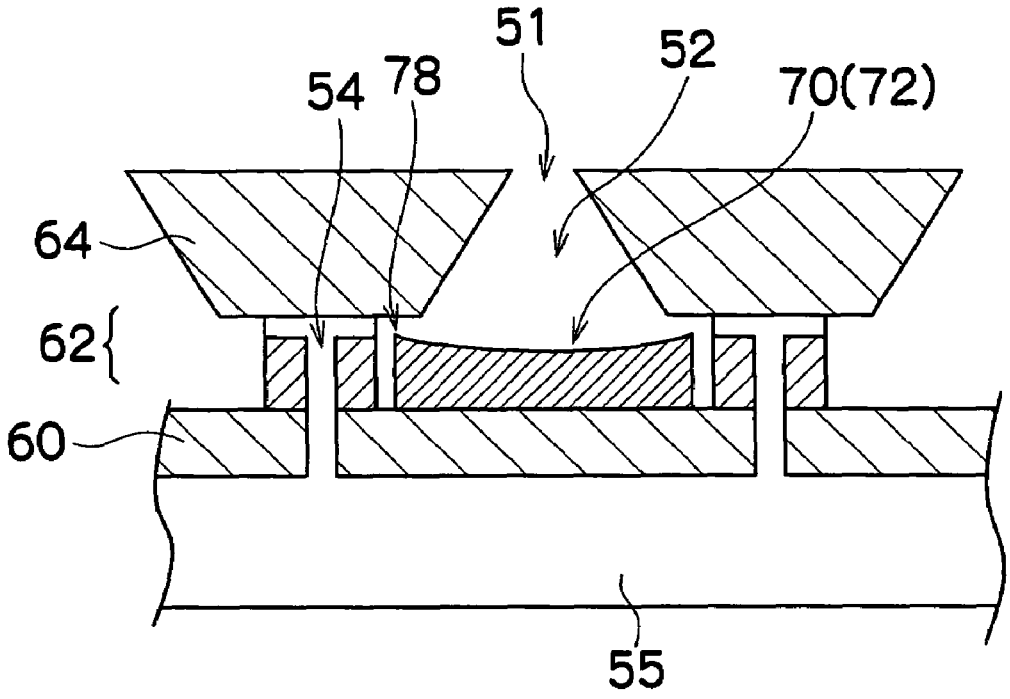
FIGS. 6A and 6B are illustrative diagrams showing displacement of a piezoelectric element.
Figure 6B:
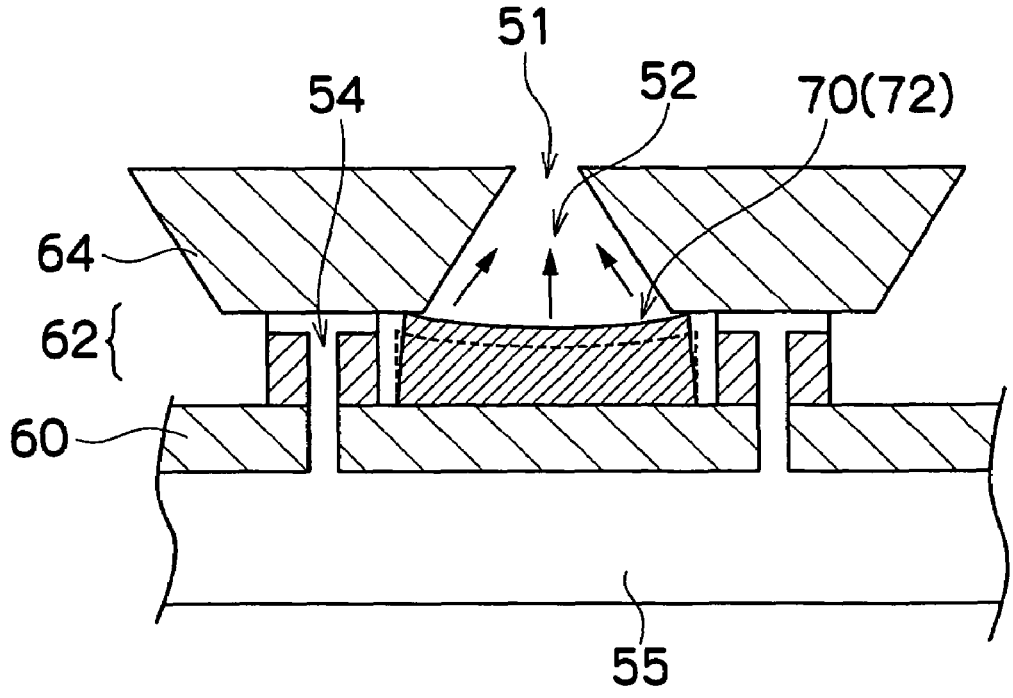

FIGS. 6A and 6B are illustrative diagrams showing displacement of the piezoelectric element 70. FIG. 6A shows a state during refilling, and FIG. 6B shows a state during ink ejection.

During refilling where ink is supplied to the pressure chamber 52 from the common liquid chamber 55 through the ink supply flow channel 54, the piezoelectric element 70 is in a non-driving state where no voltage is applied to the piezoelectric element 70. In this case, as shown in FIG. 6A, a gap 78 is formed between the end section of the upper surface of the piezoelectric element 70 and the surface of the cavity plate 64 on the side adjacent to the spacer plate 62, and the ink supply flow channel 54 thereby assumes an open state with respect to the pressure chamber 52, and ink can be supplied to the pressure chamber 52 from the common liquid chamber 55. If the gap 78 is narrow during the non-driving state of the piezoelectric element 70, then it forms a flow channel resistance to the ink which may affect the refilling characteristics. Hence, desirably, the gap 78 is composed so as to be sufficiently broad. In this refilling mode, apart from the foregoing aspect, it is also possible to fill ink into the pressure chamber 52 after an ejection operation, in a state where a voltage is applied to the piezoelectric element 70.

On the other hand, during ink ejection for ejecting an ink droplet from the nozzle 51, as shown in FIG. 6B, the piezoelectric element 70 is in a driving state where a prescribed voltage is applied to the piezoelectric element 70, and the volume of the pressure chamber 52 is reduced by the displacement of the piezoelectric element 70 (piezoelectric body 72) in the longitudinal direction (d33 direction), thereby applying pressure directly to the ink in the pressure chamber 52.

The piezoelectric element 70 is constituted in such a manner that a portion of the piezoelectric element 70 makes contact with the cavity plate 64 in the driving state where the prescribed voltage is applied. More specifically, the piezoelectric element 70 is composed in such a manner that, by means of the displacement of the piezoelectric element 70 (piezoelectric body 72) in the longitudinal direction (d33 direction), the end section of the upper surface of the piezoelectric element 70 (piezoelectric body 72) makes contact with the surface of the cavity plate 64 on the side adjacent to the spacer plate 62. In the present embodiment, in the most desirable mode, the portion of the piezoelectric element 70 makes contact with the cavity plate 64 during ink ejection, but a composition may also be adopted in which the ink flow channel resistance from the pressure chamber 52 toward the ink supply flow channel 54 becomes greater during ink ejection than during refilling. More specifically, a composition may be adopted in which the gap 78 during refilling (see FIG. 6A) becomes smaller than the gap 78 during ink ejection. Thereby, reverse flow of the ink from the pressure chamber 52 toward the common liquid chamber 55 during ink ejection is prevented, and there is little loss in the pressure applied to the ink inside the pressure chamber 52, and hence the ink ejection efficiency is good.

As described above, the piezoelectric element 70 is larger than the maximum diameter of the tapered pressure chamber 52, and smaller than the diameter of the cylindrical section 62*a*. The side surface of the piezoelectric element 70 is disposed to the outer side of the pressure chamber 52. Consequently, during ink ejection (in other words, during driving of the piezoelectric element 70), it is possible to apply pressure directly to the ink inside the pressure chamber 52 due to the displacement of the piezoelectric element 70 (piezoelectric body 72) in the longitudinal direction (d33 direction), without being affected by the displacement of the piezoelectric element 70 (piezoelectric body 72) in the transverse direction (d31 direction). In other words, if the whole of the piezoelectric element 70 (piezoelectric body 72) is disposed inside the pressure chamber 52, then during ink ejection, the change in the volume of the pressure chamber 52 due to displacement of the piezoelectric element 70 (piezoelectric body 72) in the longitudinal direction (d33 direction) and the change in the volume of the pressure chamber 52 due to displacement in the transverse direction (d31 direction) act contrarily to each other, and hence a phenomenon occurs whereby the volume change in the pressure chamber 52 is ultimately cancelled out (for example, the volume change in the pressure chamber 52 due to the displacement in the transverse direction is reduced when the volume change in the pressure chamber 52 due to the displacement in the longitudinal direction increases). However, in the present embodiment, by adopting the composition as described above, the phenomenon of the volume change in the pressure chamber 52 being cancelled out by the displacement in the transverse direction (d31 direction) is eliminated, and hence the ink ejection efficiency is improved.

Furthermore, the upper surface of the piezoelectric element 70 (piezoelectric body 72) is formed so as to be recessed in an approximate curved shape in the central region. More specifically, the surface of the piezoelectric element 70 (piezoelectric body 72) on the side facing to the nozzle 51 is formed in an approximately curved surface in which the thickness of the piezoelectric element 70 (piezoelectric body 72) reduces gradually from the end regions to the central region. In other words, the piezoelectric element 70 (piezoelectric body 72) has a smaller thickness in the central region than in the end regions. In particular, most desirably, the piezoelectric element 70 (piezoelectric body 72) is composed in an approximately curved shape whereby the normals to the upper surface are oriented toward the approximate center of the nozzle 51.

The piezoelectric element 70 having the upper surface with the approximate curved shape which is recessed in the central region in this way is manufactured in the following manner. An electrode layer corresponding to the lower electrode 76 is formed onto a flat substrate corresponding to the base plate 60 as shown in FIG. 5, and a film of piezoelectric material is then formed by aerosol deposition (AD) or sputtering on top of the electrode layer, thereby forming a flat planar piezoelectric body 72 on the upper surface. Subsequently, the upper surface of the piezoelectric body 72 is processed into a substantially curved shape by means of a laser, or the like, and an electrode layer corresponding to the upper electrode 74 is then formed by screen printing, or the like, on the piezoelectric body 72. Finally, a protective film made of resin, or the like, is formed on the surface of the piezoelectric body 70. It is possible to manufacture the piezoelectric elements 70 according to the present embodiment in this way. If a substrate is used which is formed with curved recess sections in the sections where the piezoelectric elements 70 are disposed, instead of a flat substrate, then the piezoelectric bodies 72 having an approximately curved upper surfaces are formed by depositing a film of piezoelectric material in the recess sections, and no processing by the laser is necessary.

By using the piezoelectric element 70 having this composition, the ink inside the pressure chamber 52 is pressurized in directions almost directly toward the nozzle 51 (the directions indicated by the arrows in FIG. 6B), by means of the displacement of the piezoelectric element 70 (piezoelectric body 72) in the longitudinal direction (d33 direction). More specifically, the directions of propagation of the pressure applied to the ink inside each pressure chamber 52 converge at the nozzle 51. Furthermore, since the pressure chamber 52 is formed with the tapered section 52*a* whereby the diameter reduces gradually toward the ink ejection direction (in other words, the nozzle 51 side), then the ink inside the pressure chamber 52 is made to converge more readily at the nozzle 51. Consequently, pressure loss is reduced and ink ejection efficiency is improved yet further.

As described above, in the print head 50 according to the present embodiment, during ink ejection (in other words, in the driving state of the piezoelectric element 70), it is possible to apply pressure directly to the ink inside the pressure chamber 52, by means of the displacement in the longitudinal direction (d33 direction) of the piezoelectric element 70 disposed inside pressure chamber 52. Furthermore, during ink ejection, the flow channel resistance from the pressure chamber 52 toward the ink supply flow channel 54 is increased by the displacement of the piezoelectric element 70 in the longitudinal direction (d33 direction), thereby preventing reverse flow of the ink from the pressure chamber 52 toward the common liquid chamber 55. Moreover, since the side surfaces of the piezoelectric element 70 (piezoelectric body 72) are positioned to the outer side of the pressure chamber 52, then no effects are caused by displacement of the piezoelectric element 70 in the transverse direction (d31 direction). Furthermore, since the piezoelectric element 70 (piezoelectric body 72) has an approximately curved surface in which the central region of the surface facing the nozzle 51 is recessed, and since the pressure chamber 52 is formed with the tapered section 52*a* in which the diameter reduces gradually toward the ink ejection direction (in other words, the nozzle 51 side), then the propagation directions of the pressure applied to the ink inside the pressure chamber 52 converge at the nozzle 51. Consequently, the loss in the pressure applied to the ink inside the pressure chamber 52 is reduced, and the ink ejection efficiency with respect to the displacement of the piezoelectric element 70 is improved.

In the present embodiment, a composition is described in which a state where the voltage is applied to the piezoelectric element 70 (driving state) corresponds to ink ejection, and a state where the voltage is not applied to the piezoelectric element 70 (non-driving state) corresponds to refilling, but the implementation of the present invention is not limited to this, and it is also possible to make the driving state of the piezoelectric element 70 correspond to refilling, and the non-driving state of the piezoelectric element 70 correspond to ink ejection.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a pressure chamber which is connected to an ejection port ejecting liquid, the liquid being supplied to the pressure chamber from a supply flow channel; and a piezoelectric element which forms a wall surface of the pressure chamber facing to the ejection port, wherein, during liquid ejection, the liquid inside the pressure chamber is pressurized by means of displacement of the piezoelectric element in d33 direction, and a gap formed between a partition of the pressure chamber and the piezoelectric element is made narrower than during refilling, in such a manner that flow resistance of the liquid from the pressure chamber toward the supply flow channel becomes greater than during refilling.

2. The liquid ejection head as defined in claim 1, wherein a surface of the piezoelectric element on a side facing to the ejection port has an approximately curved surface in which a central region thereof is recessed.

3. The liquid ejection head as defined in claim 1, wherein the pressure chamber has a tapered section in which a diameter becomes smaller toward the ejection port.

4. The liquid ejection head as defined in claim 1, further comprising a common liquid chamber which accumulates the liquid to be supplied to the pressure chamber through the supply flow channel, the common liquid chamber being arranged on a side of the piezoelectric element reverse to a side facing to the ejection port.

5. An image forming apparatus, comprising the liquid ejection head as defined in claim 1.

* * * * *